United States Patent [19]

Lenhard et al.

[11] 4,007,372

[45] Feb. 8, 1977

[54] METHOD AND ARTICLE FOR IMAGE REPRODUCTION

[75] Inventors: Myron J. Lenhard, Penfield; Richard F. Selig, Fairport, both of N.Y.

[73] Assignee: Xerox Corporation, Stamford, Conn.

[22] Filed: Mar. 26, 1975

[21] Appl. No.: 562,321

[52] U.S. Cl. ..... 250/317; 427/145

[51] Int. Cl.[2] ..... G03C 5/16

[58] Field of Search ..... 250/318, 317, 316; 101/472, 471; 427/145

[56] References Cited

UNITED STATES PATENTS

| | | | |
|---|---|---|---|
| 3,260,612 | 7/1966 | Dulmage et al. | 250/317 |
| 3,601,484 | 8/1971 | Dybvig et al. | 250/317 |

FOREIGN PATENTS OR APPLICATIONS

| | | | |
|---|---|---|---|
| 951,987 | 3/1964 | United Kingdom | 250/317 |

*Primary Examiner*—Alfred E. Smith
*Assistant Examiner*—T. N. Grigsby
*Attorney, Agent, or Firm*—James J. Ralabate; Clarence A. Green; William A. Henry, II

[57] ABSTRACT

A method of image reproduction is disclosed wherein an image is reproduced by selectively activating a surface of an image transfer body to form a tackified image configuration on the surface and contacting the surface with a transfer developer material which adheres to the tacky surface in image configuration. The developer material comprises a sublimable dye. The transfer body surface is positioned adjacent a surface of a receiving body and the adhering developer material is heated to a temperature for causing the dye to sublimate and thereby transfer in image configuration to the adjacent surface of the receiver body. The transfer and receiver bodies are separated and a reproduction of the image is retained on the receiver body. A number of copies are produced by repeatedly replacing the receiver body and reheating the adhering material. A reproduction master for use with this method is also disclosed.

24 Claims, 21 Drawing Figures

METHOD AND ARTICLE FOR IMAGE REPRODUCTION

Figure 1A:
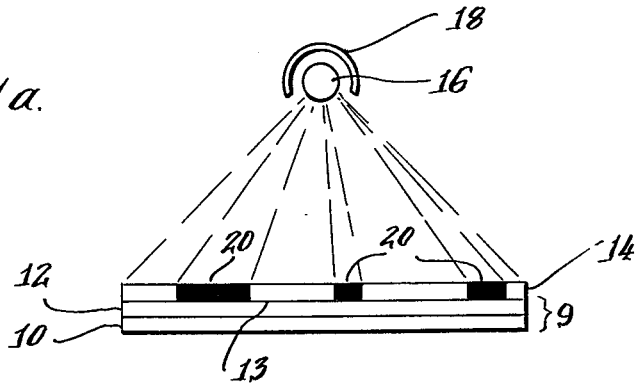
Figure 1B:
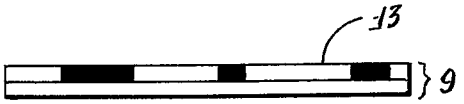

This invention relates generally to image reproduction and more particularly to an improved method and article for reproducing images through surface tackification techniques.

In one method of image reproduction, an image transfer body having a thermoplastic surface is provided. The body comprises, for example, a sheet of substrate which is coated with a layer of thermoplastic material having a latent adhesive characteristic which is activated by selectively heating the material to cause tackification thereof in image configuration. The thermoplastic material exhibits a delayed tackification characteristic whereby the surface retains the tacky image configuration for a period of time sufficient for enabling development of the image. Development is accomplished by contacting the thermoplastic surface with a toner material which adheres to the tacky surface in image configuration. The transfer sheet is then brought into contact with a surface of a receiver sheet and is reheated in order to soften the toner material which transfers in image configuration to the surface of the receiver. A reproduction of the original image is thus provided on the receiver sheet.

While this technique for image reproduction has proven effective, the technique has heretofore been applied to single copy monochromatic reproduction.

Accordingly, it is an object of this invention to provide an improved method and article for image reproduction.

Another object of the invention is to provide a tackification reproduction method which provides a plurality of copies with a single imaging.

Another object of the invention is to provide a tackification reproduction technique for color copying.

A further object of the invention is to provide an improved transfer sheet for use in a tackification reproduction system.

In accordance with features of the method of this invention, an image is reproduced by selectively activating a surface of an image transfer body to form a tackified image configuration on the surface and contacting the surface with a transfer developer material which adheres to the tacky surface in image configuration. The developer material comprises a sublimable dye. The transfer body surface is positioned adjacent a surface of a receiving body and the adhering developer material is heated to a temperature for causing the dye to sublimate and thereby transfer in image configuration to the adjacent surface of the receiver body. The transfer and receiver bodies are separated and a reproduction of the image is retained on the receiver body. A number of copies are produced by repeatedly replacing the receiver body and reheating the adhering material.

In one embodiment of this invention, the developer material comprises heat absorbent bodies in thermal contact with a sublimable dye. Sublimation of the dye is accomplished by heating these bodies to the sublimation temperature. In an alternative embodiment, the developer material is caused to sublimate by heating a heat absorbent substrate member of the transfer body or a heat absorbent tackifying material which is coated on the substrate member.

In accordance with other features of the reproduction method of this invention, an image is reproduced by selectively activating a surface of a first image transfer body to form a first color component tackified image configuration which is representative of a first color component of the original image obtained using conventional color subtraction techniques and selectively activating a surface of a second image transfer body to form a second color component tackified image configuration which is representative of a second color component of the original image. The surfaces of the first and second bodies are contacted with first and second developer materials, respectively, which comprise a sublimable dye. The dyes of the first and second developer materials are adapted for developing the image color component of the first and second bodies, respectively. The imaged surface of the first transfer body is positioned adjacent a surface of a receiving body and the adhering developer material is heated for causing the dye to sublimate and thereby transfer the first image color component to the adjacent surface of the receiver body. After this image component transfer, the first transfer body is separated from the receiver body and the image surface of the second transfer body is positioned adjacent the surface of the receiving body and in registry with the first color component previously transferred to the receiver body. The developer material of the second transfer body is heated to a temperature for causing the dye to sublimate and to transfer the second color component image to the adjacent surface of the receiver body. The receiver body and the second transfer body are separated and there is thus provided a resultant color composite image at the receiver.

In accordance with other features of the invention, an image reproduction master for use in tackification reproduction techniques comprises an image transfer body having a surface thereof which is adapted to be activated to tackification in image configuration for an interval of time upon removal of the activation and a developer material adhering to the surface of the transfer body in image configuration, the developer material comprising a sublimable dye, whereby heating of said dye causes the sublimation of the dye.

In accordance with more particular features of the article of this invention, the transfer body is provided, in one embodiment, by a heat softenable material coated on a substrate. A surface of the heat softenable material is activated to tackiness in image configuration by the application of heat thereto in image configuration. The transfer body substrate and the heat softenable coating are alternatively formed of a heat absorbent material which can be heated for imaging and causing sublimation. The developer material comprises a sublimable dye or alternatively a sublimable dye mixed with heat absorbent bodies. The heat absorbent bodies are formed of various materials including metals, polymers and ceramics.

In a further alternative embodiment of the article of this invention, the substrate coating is formed of a material which is activated to tackiness in image configuration by contacting the surface thereof with solvent vapors for the material.

These and other objects and features of the invention will become apparent with reference to the following specifications and to the drawings wherein:

FIG. 1 is a diagram illustrating a method and an article for reproducing images in accordance with the present invention; and, FIG. 2 is a diagram illustrating a method for reproducing images in color in accordance with the present invention.

Referring now to FIG. 1 of the drawings, a transfer body 9 upon which an intermediate image is formed is shown to comprise a sheet having a substrate 10 which is coated with a layer 12 of a material which, upon activation, becomes tacky. Although the body is shown to comprise a single transfer sheet of fixed dimensions, the body can equally well comprise a web, an endless belt or a drum surface. The layer 12 is formed of a heat softenable material such as a thermoplastic adhesive which becomes tacky upon activation. The transfer sheet 9 provides a surface 13 which is activated to form a tackified surface in image configuration. Activation of the thermoplastic is accomplished by selectively heating the surface 13. Selective heating is effected in one arrangement, as illustrated, by positioning a document 14 bearing an image which is to be reproduced in contact with the surface 13 and subjecting the assembly to electromagnetic radiation from an energy source 16. The radiation preferrably extends principally in the infra-red range of the spectrum. A reflector 18 is positioned with respect to the source 16 for reflecting radiation toward the document 14. The source 16 comprises, for example, a tungsten lamp. Infra-red radiation from a tungsten lamp can amount to as much as 85% of the radiated energy. The document 14 bears an image which is represented, as illustrated in FIG. 1*a*, by relatively dark pigmented segments 20. These segments absorb the incident radiant energy; they become heated; and, they thereby heat the juxtaposed surface segments of the layer 12. The nonimaged areas of the document 14, i.e., the non-pigmented segments of the image, transmit radiant energy therethrough; they are not significantly heated; and, they therefore do not heat and activate the adjacent surfaces of the adhesive layer 12. Upon heating, the adhesive layer 12 becomes sensitized and tacky in image configuration. The document 14 and the transfer sheet 9 are then separated and a tackified sheet in image configuration is provided as is illustrated in FIG. 1*b*.

As indicated, the transfer sheet comprises a substrate 10 which is coated with an adhesive 12. The substrate 10 may be formed of paper or plastic. Suitable substrates include, for example, an organic film such as a polyester film, cellulose acetate or triacetate film. In one embodiment of the invention, the substrate comprises a heat absorbent body which can comprise a metal or polymer mixed with a black pigment or colorant.

The adhesive 12 comprises a delay adhesive which is normally hard and non-tacky at room temperature, but which, upon being activated by heat to a tacky condition and subsequently cooled to room temperature, thereafter remains tacky for considerable periods of time varying from at least 30 seconds to several days or more depending upon the particular composition involved. When development is accomplished as described herein by manual techniques, the delay interval is preferably on the order of 8 to 15 minutes.

Delayed tacky coatings are well known and can be a mixture of discrete particles of resin such as indene resin or esterified resin and discrete particles of crystalline plasticizer such as diphenyl phthalate or N-cyclohexyl paratoluene sulfonamide. The particles are bound together into the supporting film by a binder such as styrene-butadiene copolymer. Generally speaking, the crystalline plasticizer component of the mixture is in excess of the resin component. In one embodiment of the invention, the delay adhesive is heat absorbent and is provided by mixing a black pigment or colorant with the resin.

A particular delay adhesive which may be employed comprises 85 parts of diphenyl phthalate, 15 parts styrene butadiene rubber, 1 part DRESINATE X, an emulsifier manufactured by Hercules, Inc., of Wilmington, Delaware and 1 part polyvinyl pyrrolidone. The diphenyl phthalate comprises the crystalline plasticizer in which the particles range in size from 1 to 5 microns.

Selective heating of the transfer sheet in order to provide a tackified image configuration is provided in accordance with one embodiment of the invention by contact heating as illustrated in FIG. 1*a*. Contact heating requires heat absorbing imaged areas in document 14 such as the dark pigmented segments 20 of the document. The document is exposed to radiation from the source 16 for an interval of time for providing a tackiness sufficient to develop adhesive forces for adhering developer material thereto.

The adhesive surface 12 may be alternatively selectively heated to provide a tackified image configuration on the surface thereof by contact heating with a dielectric matrix having a configuration conforming to the image to be reproduced, by point scanning the surface with a high energy laser beam which is intensity modulated in accordance with the image to be reproduced, by line or slit scanning the surface with infra-red radiation in image configuration, and by flash exposing the surface with a xenon lamp to an image configuration. In a particular alternative sensitizing arrangement, the coating 12 or substrate 10 are heat absorbent and the surface is activated in image configuration by projecting infra-red radiation in image configuration at the transfer body. The coating 12 is partly heated in the former case while it is heated in image configuration by contact with the substrate in the latter case. In order to provide a positive to positive copy with the method, a negative image configuration is projected at the transfer body.

In addition to thermal activation, the layer 12 may be formed of a material which is sensitized and rendered selectively tacky by vaporized solvents. Imaging is accomplished by masking the surface 13 with a stencil conforming to the image and contacting the exposed portion of the surface 13 with solvent vapors. Suitable materials comprise a binder polymer admixed with a tackifying material. Examples of suitable polymer binders and tackifying materials are styrene-butadiene admixed with triphenylphosphate; Rhoplex B-15 (an acrylic emulsion available from ROHM AND HASS CO.) admixed with dicyclohexyl phthalate (a crystalline plasticizer); and polystyrene admixed with diphenyl phthalate. Examples of suitable activating vapor solvents are acetone, xylene and chlorinated hydrocarbons.

Figure 1C:
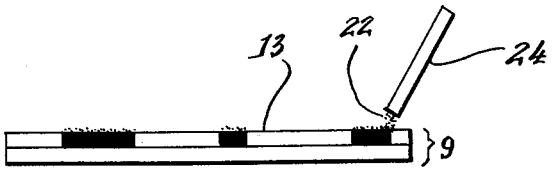

The transfer sheet 9 bearing a tackified image representation is developed as illustrated in FIG. 1*c* by contacting the tackified surface 13 with a developer material. The developer material comprises a sublimable dye. In one embodiment of the invention, adhesive forces of the tackified areas cause the developer material to adhere to the surface 13 and provide a developed image. The surface 13 can be contacted by the developer material through various techniques. In one technique, the developer material includes magnetic bodies and, as illustrated in FIG. 1*c*, the image is developed by forming a brush 22 at one end of a bar magnet 24 and by advancing the bar magnet 24 with the brush 22 in contact with the surface 13. The adhesive force of the tackified areas of the surface 13 overcomes the attractive force of the magnet 24 thereby attracting and adhering the developer material to the tackified segments. Alternatively, the developer material contacts the surface 13 by dusting the surface with the developer material. The surface may be conveniently dusted with a powder puff applicator. The material thus deposited adheres to the tackified surfaces and residual material in the non-tackified surfaces may be removed by flowing a light air stream across the surface.

The developer material in accordance with the invention comprises a sublimable dye. It is prepared by spray-drying a solution of a dye concentrate such as Cerise B concentrate TLX-1548 available from DuPont Corporation and a solvent such as chloroform. The developer material, in another embodiment, includes heat absorbent bodies. The heat absorbent bodies are selected to have a softening temperature which is greater than the sublimation temperature of the dye. Thus, when the heat absorbent bodies are heated to the sublimation temperature, the dye sublimes and, as indicted hereinafter, transfers in image configuration to an adjacent receiver sheet. The heat absorbent bodies comprise a black or dark material such as carbon black, black ceramics, black glass beads, black polymers and metals. When a metal is utilized, it can comprise magnetic or non-magnetic particles which are mixed with the dye and a binder or are coated with a dye solution. Illustrative of suitable developer materials are, for example, a developer comprising about 40 parts by weight of black magnetic iron oxide mixed with 10 parts by weight of dye in 50 parts by weight of polycarbonate binder. As an example of the coated developer, the material can comprise magnetite particles which are coated with a solvent containing 10% of a sublimable dye which is air dried.

Heat absorbent developer bodies formed from a polymer are provided by dissolving a sublimable dye in a polymer and a heat absorbent pigment. Polymers should be selected which allow ready diffusion of the dye from the matrix upon heating to the sublimation temperature. Examples of suitable polymers are polycarbonate, polyester and nylon. A suitable pigment comprises, for example, carbon black. Suitable dyes comprise, for example, Cerise B cencentrate TLX-1548, Blue 4R concentrate TLX-1579 and yellow 3G concentrate TLX-1572 available from the DuPont Corporation.

The polymer developer mixture can be spray dried and ground to a powder having the desired consistency. This material comprises a mixture wherein the polymer remains hard during sublimation of the dye. The polymer preferably has a softening temperature which is substantially greater than the sublimation temperature of the dye and preferably at least 50° C greater.

As is indicated hereinafter, a plurality of copies are provided from a single imaged transfer sheet. The number of copies which are provided depends in large part on the concentration of the dye in the mixture. The dye concentration can vary within a range of from about 2 to 30% by weight of the developer and preferably from about 5 to 15% by weight of the developer without materially affecting other desirable properties of the developer.

Figure 1D:
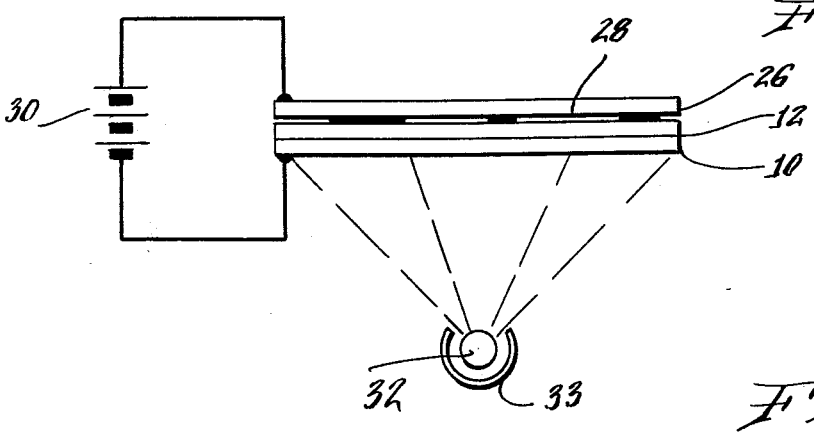

After development of a tackified image, the transfer sheet is positioned adjacent a receiver sheet 26, as illustrated in FIG. 1*d*. The developer material is reheated causing sublimation of the dye and transfer thereof in image configuration to the adjacent receiver sheet. Preferably, the developed surface of the transfer sheet contacts the surface 28 of the receiver sheet in order to reduce lateral movement of the sublimed dye between these sheets. Intimate contact between these surfaces can be provided by establishing an electrostatic charge therebetween which is applied thereto from a source of potential 30. Alternatively, intimate contact can be provided by exerting pressure upon the adjacent sheets such as with a platen press (not shown) or by passage of the sheets through the nip formed by a pair of rotating rolls (not shown) either sequentially or simultaneously with reheating to effect sublimation. As illustrated in FIG. 1*d*, the developer material is reheated by reflecting infra-red radiation from a tungsten source 32 via reflector 33 at the transfer body. The heat absorbent bodies, or alternatively, a heat absorbent substrate or heat absorbent coating material are heated and cause sublimation of the dye. Alternatively, the assembly of FIG. 1*d* is subjected to a flash exposure from a xenon lamp which provides, for example, an energy transfer of 10 joules/cm$^2$ for full frame transfer. Reheating may also be accomplished by scanning, as indicated hereinbefore. The receiver sheet 26 is preferably a treated paper which is receptive to sublimed dye molecules or a plastic similarly receptive to sublimed dye molecules. Mylar is an example of a preferable receiver sheet.

Figure 1E:
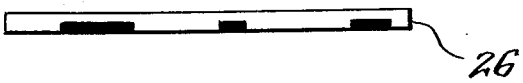

After an interval of time, intimate contact is released. The transfer sheet 9 is separated from the receiver sheet with an image configuration remaining on the receiver sheet as illustrated in FIG. 1*e*.

The developed transfer sheet of FIG. 1*c* comprises a master from which a plurality of copies may be formed. Therefore, subsequent to the separation of the transfer sheet and receiver sheet in FIG. 1*d*, a second receiver sheet is brought into contact with the transfer sheet; the developer material is reheated, and the residual dye sublimes and transfers to the receiver sheet and forms a second copy. Additional copies may be provided by separating the transfer and receiver sheet and substituting additional receiver sheets.

Figure 2A:
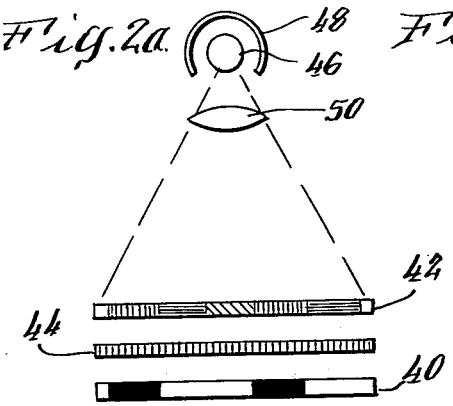
Figure 2D:
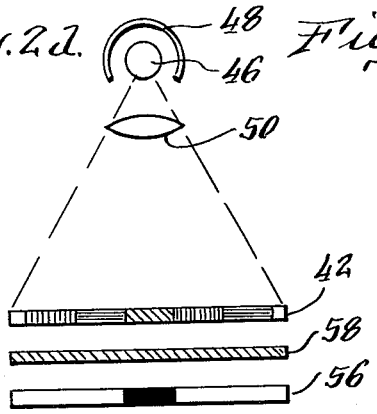
Figure 2G:
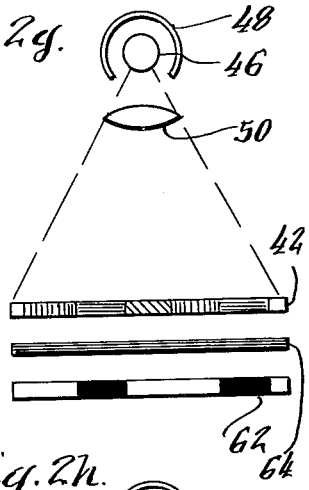
Figure 2B:
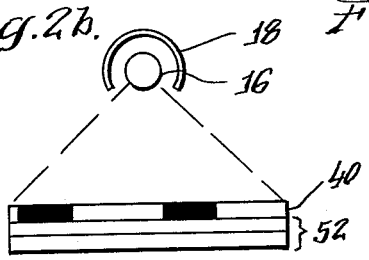
Figure 2E:
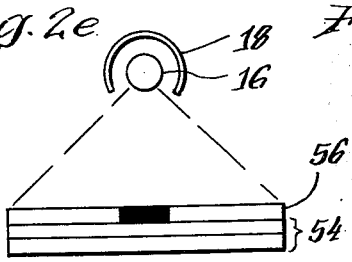
Figure 2H:
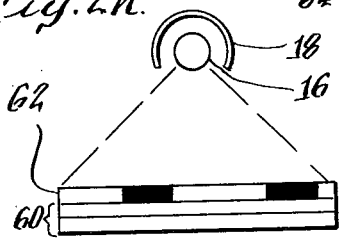
Figure 2C:
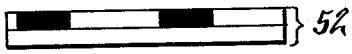
Figure 2F:
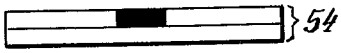
Figure 2I:
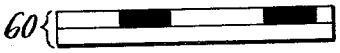
Figure 2J:
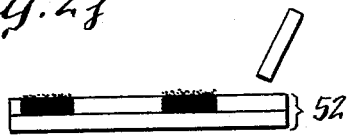
Figure 2K:
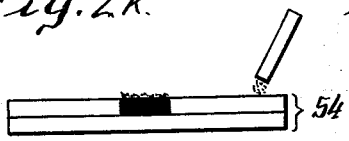
Figure 2L:
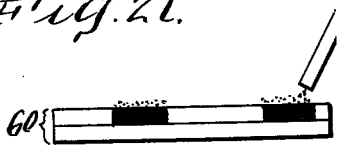
Figure 2L:
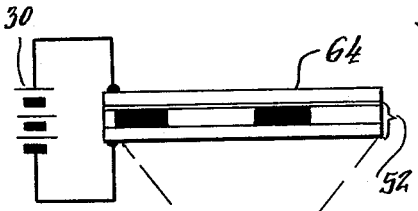
Figure 2L:
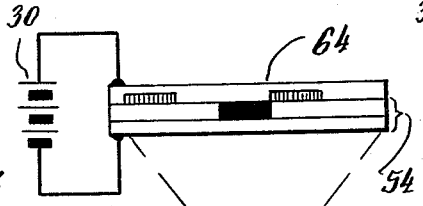
Figure 2L:
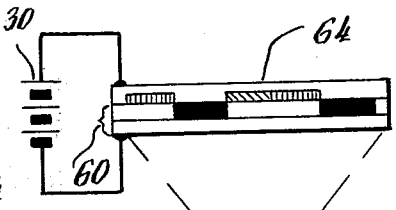
Figure 2M:
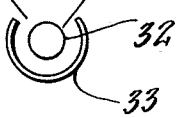
Figure 2N:
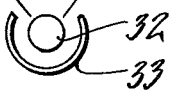
Figure 2O:
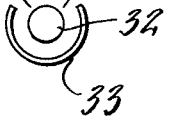
Figure 2P:
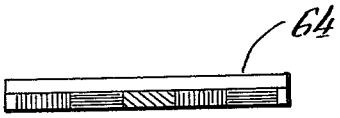

Composite color images may be formed in accordance with features of the method of this invention, as illustrated in FIGS. 2*a*–2*p*. Those elements of FIG. 2 which perform functions similar to elements in FIG. 1 described hereinbefore bear the same reference numerals. In general, a composite color reproduction is provided by imaging separate transfer sheets with different color components of the original, developing the color component images on the transfer sheet with dyes for the particular component and sequentially transferring the color component to a receiving sheet. A first transfer sheet bearing a tackified image representation of a first color component is produced as illustrated in FIGS. 2*a*, 2*b*, and 2*c* by exposing a photosensitive film 40 to the color original 42 to be reproduced through a first color filter 44 in accordance with color subtractive processes well known in the art. Exposure is provided by a lamp 46, a reflector 48 and a lens 50. The exposed photosensitive film 40 is developed and provides a monochrome image representation of a color component of the original. The film 40 is then developed and is placed in contact with the surface of a transfer sheet 52 and is activated to provide a tackified image representation on the transfer sheet 52 as is illustrated in FIG. 2*c*.

Similarly, a second transfer sheet 54 having a tackified image representation of a second color component of the original 42 is provided by exposing a photosensitive film 56 through a second color filter 58 to the original as is illustrated in FIG. 2*d*. The photosensitive film 56, upon development, is utilized, as illustrated in FIG. 2*e*, to activate the transfer sheet 54 and provide a tackified surface in image configuration of the second color component as illustrated in FIG. 2*f*. A third transfer sheet 60 is also provided by exposing a photosensitive film 62 to the original 42 through a third color filter 64 as illustrated in FIG. 2*g*. Upon development, the photosensitive film 62 is positioned adjacent the transfer sheet 60 in order to activate the surface of the transfer sheet 60 and provide a tackified surface in image representation of the third color component as shown in FIG. 2*i*.

Development of the transfer sheets 52, 54 and 60 is provided by contacting the activated surface with developer material through the use of a magnetic brush as illustrated in FIGS. 2*j*–2*l*. In FIG. 2*j*, the developer material which contacts the activated surface includes a dye selected for developing the first color component of the image to be reproduced. Similarly, the developer material which contacts the activated surface of the transfer sheet 54 of FIG. 2*k* comprises a second dye selected for developing the second color component of the image to be reproduced while the developer material contacting the activated surface of the transfer sheet 60 in FIG. 21 comprises a third dye selected to develop the third color component of the image to be reproduced. The developer materials applied to the activated surfaces of the transfer sheets 52, 54, and 60 can include dyes for developing magenta, yellow and cyan color image components.

The developed transfer sheets 52, 54 and 60 are then each positioned in contact with a receiver sheet 64 in sequence and the developer material is heated in order to cause sublimation of the dye. As illustrated in FIG. 2*m*, the transfer sheet 52 is placed in contact with the receiving sheet 64 and is heated by radiation from the source 32. The sheets 52 and 64 are separated and the transfer sheet 54 is then brought into contact with the receiver sheet 64. This contact is made in registry with respect to the color component which was previously transferred to the receiver sheet 64 from the transfer sheet 52. Registry can be accomplished by various means including, for example, the use of registration holes in the transfer sheets and the receiver sheet which when aligned provide for proper registration. The developer material on transfer sheet 54 is then heated to sublimation of the dye; the second color image component thereby transfers to the receiver sheet 64; and, the sheets 54 and 64 are separated. Transfer sheet 60 is then positioned in registration and contact with the receiver sheet 64; the developer material thereon is heated until sublimation of the dye occurs; the third color component thereby transfers to the receiver sheet 64; and, the receiver sheet 64 and transfer sheet 60 are separated to provide the receiver sheet 64, as illustrated in FIG. 2*o*, having a composite full color reproduction of the original 42. Multiple color reproductions can be provided by replacing the transfer sheet 64 and repeating the steps of FIGS. 2*m*, 2*n* and 2*o*.

The following examples of the preparation of developer materials employed in practicing this invention are given by way of illustration and not by way of limitation in the practice of the invention is producing copies from an original.

EXAMPLE 1

EXAMPLE 1

| Metallic Heat Absorbent Bodies | Grams |
|---|---|
| Black Magnetic Iron Oxide | 150 |
| Dye Concentrate (DuPont Corporation Cerise B Concentrate TLX-1548 | 20 |
| Lexan 101 Polycarbonate | 42 |
| Pentane | 75 |
| Ethylene Dichloride | 378 |
| Chloroform | 675 |

The composition was formulated as a slurry and was spray dried on a Bowen Engineering 30 in. diameter laboratory model spray drier, having a 2 inch spinning disc atomizer which was operated at 50,000 rpm. An air inlet temperature was set between 120°–130° F. The slurry was gravity fed with agitation at the rate of about 200 ml. per minute. The spray dried material was separated to provide a yield of about 154 grams.

EXAMPLE 2

EXAMPLE 2

| Metallic Heat Absorbent Bodies | Grams |
|---|---|
| Black Magnetic Iron Oxide | 150 |
| Dye Concentrate (DuPont Corporation Blue 4R Concentrate TLX-1579) | 20 |
| Lexan 101 Polycarbonate | 42 |
| Pentane | 75 |
| Ethylene Dichloride | 378 |
| Chloroform | 675 |

This formulation was spray dried as described with respect to Example 1 to provide a yield of 145 grams.

EXAMPLE 3

EXAMPLE 3

| Metallic Heat Absorbent Bodies | Grams |
|---|---|
| Black Magnetic Iron Oxide | 150 |
| Dye Concentrate (DuPont Corporation Yellow 3G Concentrate TLX-1572) | 20 |
| Lexan 101 Polycarbonate | 42 |
| Pentane | 75 |
| Ethylene Dichloride | 378 |
| Chloroform | 675 |

The formulation was spray dried as described with respect to FIG. 1 to provide a yield of 163 grams.

EXAMPLE 4

EXAMPLE 4

| Polymeric Heat Absorbent Bodies | Grams |
|---|---|
| Neo Spectra Carbon Black | 20 |
| Dye Concentrate (DuPont Corporation Cerise B Concentrate TLX-1548) | 20 |
| Lexan 101 Polycarbonate | 42 |
| Pentane | 75 |
| Ethylene Dichloride | 378 |
| Chloroform | 675 |

This formulation was spray dried as described in Example 1 to provide a yield about 100 grams.

EXAMPLE 5

Color Image using sublimable dye

A sample of material as described in Example 1 was used in the following image producing process: An image transfer body coated with a delay tack adhesive comprising 85 parts diphenyl phthalate, 15 parts styrene butadiene rubber, 1 part DRESINATE X and 1 part polyvinyl pyrrolidone, was selectively activated via the radiant energy from a 3M Thermofax machine. After activation, the tackified image areas were developed with the material cited in Example 1 which contained DuPont Corp. Cerise B Concentrate dye TLX-1548. After development with a magnetic brush, the image transfer body was placed in contact with a receiver sheet with the developed side against the receiver sheet. The transfer body receiver sheet sandwich was then subjected to a DC corona charge to obtain intimate contact between the developed images and the receiver sheet. The "sandwich" was then subjected to the energy from a xenon flash lamp at $\approx 10$ joules/cm$^2$ through the backside of the transfer body sheet. The resultant heat absorbed by the black body developer particles caused the dye to sublime off the developer particles onto the receiver sheet thus creating a reproduction of the image on the receiver sheet.

EXAMPLE 6

Multiple Color Imaging via Overlaying Sublimable Dyes.

The process as described in Example 5 was repeated with the following modification: After the initial transfer of the sublimable dye, in this case using the material in Example 2 containing Dupont Corp. Blue 4R Concentrate TLX-1579, the receiver sheet was utilized in a second dye sublimation step. This second dye sublimation transfer step employed the material of Example 3. This developer, with DuPont Corp. Yellow 3G Concentrate TLX-1572, was sublimed onto the initial blue image thus resulting in a final composite green image.

EXAMPLE 7

Example 5 was repeated using the material of Example 4 in place of the material of Example 1. The process steps are the same with the only exception being the mode of development. In this Example, a camel's hair brush was used to deposit and brush the non-magnetic developer particles onto the tackified image areas of the transfer body. A magnet was used, in Example 5, as the developing instrument.

EXAMPLE 8

Example 5 was repeated with the only exception being the substitution of a 3 mil thick Mylar substrate as the receiver sheet in place of the bond paper receiver sheet used in Example 5. Similar results are obtained.

EXAMPLE 9

Example 5 is repeated with the only exception being the substitution of a delay tack adhesive coated receiver sheet in place of the bond paper. Enhanced images were obtained due to increased dye saturation into the coated paper.

An improved method and article for reproducing images through tackification techniques has thus been described. A plurality of monochrome copies are provided by imaging a single master intermediate sheet or a full color composite may be advantageously formed.

While we have described particular embodiments of the invention, it will be apparent to those skilled in the art that various modifications may be made thereto without departing from the spirit of the invention and the scope of the appended claims.

What is claimed is:

1. A reproduction master comprising:

an image transfer body having a surface thereof which is adapted to be tackified in image configuration; and, a developer material adhering to said tackified surface, said developer comprising heat absorbent developer bodies, a sublimable dye coated on a surface of said heat absorbent developer bodies whereby heating of said dye causes sublimation of said dye.

2. The reproduction master of claim 1 wherein said developer heat absorbent bodies comprises a mixture of a polymer and a heat absorbent colorant.

3. The reproduction master of claim 1 wherein said transfer body surface is formed of a material which becomes selectively activated when contacted with a solvent.

4. The reproduction master of claim 3 wherein said solvent comprises a vaporized solvent.

5. The reproduction master of claim 1 wherein said image transfer body comprises a heat softenable material coated on a substrate.

6. The reproduction master of claim 5 wherein said substrate is formed of a heat absorbent material.

7. The reproduction master of claim 5 wherein said heat softenable material is formed of a heat absorbent material.

8. The reproduction master of claim 1 wherein said developer material comprises heat absorbent bodies which are coated with said dye.

9. The reproduction master of claim 8 wherein said heat absorbent bodies are formed of a metal.

10. The reproduction master of claim 9 wherein said heat absorbent bodies are formed of iron oxide.

11. The reproduction master of claim 10 wherein said developer material comprises a mixture of metal particles, a dye, and a polymeric binder.

12. A method of reproducing an image configuration comprising the steps of;

selectively activating a surface of an image transfer body to form a tackified image configuration on said surface;

contacting said surface with a developer material whereby said material adheres to said tackified surface in image configuration;

said developer material comprising heat absorbent bodies, and a sublimable dye and wherein said sublimable dye is coated on a surface of said heat absorbent developer bodies whereby heating of said dye causes sublimation of said dye;

positioning said transfer body surface adjacent a surface of a receiving body;

heating said adhering developer material to a temperature causing said dye to sublimate and to transfer in configuration to the adjacent surface of said receiver body; and separating said image transfer and receiving bodies thereby providing a reproduction of said image configuration on said receiver body.

13. The method of claim 12, wherein said heat absorbent bodies comprise a polymer mixed with a heat absorbent colorant.

14. The method of claim 12 wherein said transfer body surface is positioned in contact with said receiver body surface.

15. The method of claim 12 wherein a plurality of copies are formed including the steps of separating said receiver body and said transfer body surface subsequent to transfer of said image, positioning a second receiving body adjacent said transfer body surface and heating said developer material to a temperature for causing said dye to sublimate and transfer to the adjacent surface of said second receiving body.

16. The method of claim 12 wherein said transfer body surface is formed of a heat softenable material and said tackified image configuration is formed on said heat softenable surface by heating the heat softenable surface in image configuration.

17. The method of claim 16 wherein said transfer body comprises a heat absorbent substrate coated with said heat softenable material.

18. The method of claim 16 wherein said transfer body comprises a substrate coated with a heat absorbent, heat softenable material.

19. The method of claim 16 wherein said tackified image is formed by positioning a body which supports an image configuration formed by heat absorbent material adjacent said heat softenable surface and heating said image configuration thereby causing the tackification in image configuration of said heat softenable surface.

20. The method of claim 19 wherein said projected electromagnetic radiation comprises energy which exists principally within the infra-red spectrum of electromagnetic radiation.

21. The method of claim 16 wherein said transfer body is heated by projecting electromagnetic radiation at said body.

22. The method of claim 21 wherein said projected radiation is projected in image configuration at said transfer body.

23. A method of reproducing an image configuration comprising the steps of:

selectively activating a surface of an image transfer body to form a tackified image configuration on said surface, wherein said transfer body surface is formed of a material which becomes selectively activated when contacted with a solvent;

contacting said surface with a developer material whereby said material adheres to said tackified surface in image configuration;

said developer material comprising a sublimable dye whereby heating of said dye causes sublimation of said dye;

positioning said transfer body surface adjacent a surface of a receiving body;

heating said adhering developer material to a temperature for causing said dye to sublimate and to transfer in image configuration to the adjacent surface of said receiver body; and separating said image transfer and receiving bodies thereby providing a reproduction of said image configuration on said receiver body.

24. The method of claim 23 wherein said solvent comprises a vaporized solvent.

* * * * *